United States Patent [19]

Cottingham

[11] Patent Number: 5,012,769

[45] Date of Patent: May 7, 1991

[54] ENERGY TRANSFER UNIT HAVING AT LEAST THREE ADJACENT PISTON MEMBERS

[76] Inventor: Brent R. Cottingham, 3255 Nottingham Rd., Ocean Springs, Miss. 39564

[21] Appl. No.: 485,649

[22] Filed: Feb. 27, 1990

[51] Int. Cl.[5] ..... F01B 7/02; F02B 25/08

[52] U.S. Cl. ..... 123/51 R; 123/193 P; 123/193 CP; 123/197 R

[58] Field of Search ..... 123/51 R, 51 AA, 51 B, 123/51 BA, 51 BD, 193 P; 92/61, 67, 75; 417/418, 437, 460, 481

[56] References Cited

U.S. PATENT DOCUMENTS

| | | | |
|---|---|---|---|
| 3,315,653 | 4/1967 | Chicurel | 123/51 B |
| 3,692,005 | 9/1972 | Buske | 123/51 R |
| 3,987,767 | 10/1976 | Buske | 123/51 R |
| 4,651,690 | 3/1987 | Yang | 92/75 |
| 4,800,858 | 1/1989 | Yang | 123/51 R |
| 4,802,449 | 2/1989 | Yang | 92/75 |

*Primary Examiner*—Willis R. Wolfe
*Assistant Examiner*—Thomas N. Moulis
*Attorney, Agent, or Firm*—Gifford, Groh, Sprinkle, Patmore and Anderson

[57] ABSTRACT

An energy transfer unit comprises an upper wall, a lower wall spaced apart from the upper wall and being substantially parallel thereto, and at least three piston members pivotably mounted between the upper wall and the lower wall forming a chamber therebetween. Each piston member includes a piston face and a first edge. The pistons are disposed between the upper wall and the lower wall whereby the first edge of one piston member is slidably engaged with the face of an adjacent piston member. Preferably four piston members are provided thereby resulting in the compression chamber defining an alternatingly expanding or contracting cube.

13 Claims, 2 Drawing Sheets

ENERGY TRANSFER UNIT HAVING AT LEAST THREE ADJACENT PISTON MEMBERS

BACKGROUND OF THE INVENTION

I. Field of the Invention

The present invention relates generally to energy transfer units where such units include internal combustion engines, pumps, compressors, and the like. More particularly, the present invention relates to an energy transfer unit comprising an upper wall, a lower wall spaced apart from the upper wall and being substantially parallel thereto, and at least three piston members pivotably mounted between the upper wall and the lower wall forming an alternatingly expanding or contracting compression chamber therebetween.

II. Description of the Prior Art

Improvements of energy transfer units including compressors, pumps and internal combustion engines are continually being sought. Ever since early experiments in the use of conventional internal combustion engines began in 1861 with the Otto engine, improvements in the manufacture and construction of such engines have been sought. For reasons obvious, a good internal combustion engine construction including pistons, valving and the like also translates into a good compressor and a good vacuum pump. Accordingly, if one improves one type of energy transfer unit, one improves all types.

Several approaches have been taken toward improving the efficiency of energy transfer units. Such advancements are well known as the four-stroke and the two-stroke engine. Other modifications include the rotary-valve engine, the two-port poppet-valve engine, and the reed-valve engine. These modifications were directed to improving valving, and to some extent have proven valuable.

However, despite all of these improvements to valving, piston construction has essentially remained the same. Pistons, as they are elongated cylinders having a face at one end and a connecting shaft at the other end, have been modified by including hemispherical piston faces and the like. A more or less radical modification of the piston engine was revealed by construction of the Stirling engine.

An even more radical modification of the piston engine may be seen in rotary engines. Such modifications include rotary engines with elliptical pistons, and rotary engines having eccentric pistons. Also known are rotary engines having concentric pistons.

The most recent and well known modification of a piston is disclosed in the Wankel engine. This engine includes a rotor in place of the conventional or modified piston. The rotor is more or less triangularly-shaped and represents the form called a trochoid. This triangular construction has slightly rounded sides, and each of its three faces includes a recess or pocket defined therein to form a combustion chamber.

However, the Wankel engine has not proved the panacea that it was hoped to be. For a variety of reasons mostly due to failed seals and the like, the Wankel never proved as commercially popular as anticipated.

Perhaps the greatest disadvantage the Wankel and other radical piston shapes have suffered from is the fact that within one compression chamber there is typically provided only one piston. Accordingly, in this construction, expansion can take place only in one direction by the movement of only one wall of the chamber.

For some time automotive engineers have known that the most efficient shape for a combustion chamber or a compression chamber was spherical. However, spherical chambers are, for all intents and purposes, impossible to create, thus automotive engineers have stopped short of improving on conventional and even more or less radical piston forms.

Accordingly, the prior approach is to solving the problem of maximizing energy transfer unit efficiency have failed and today we are still in a position where we use only a conventionally-styled piston element.

SUMMARY OF THE PRESENT INVENTION

The present invention provides a new construction for a piston assembly for use in a energy transfer unit. This new construction provides components that approximate the ideal spherical compression chamber construction in at least two dimensions, if not in three.

The energy transfer unit of the present invention comprises an upper wall, a lower wall spaced apart from the upper wall and being substantially parallel thereto, and at least three piston members pivotably mounted between the wall and the lower wall forming a chamber therebetween.

Preferably, the energy transfer unit of the present invention comprises four piston members, as this appears experimentally to be the most efficient approach. However, three piston members may also prove workable.

The upper wall and the lower wall provide for fixed walls of the compression chamber as well as for carrying the bearings for the crank shafts and the piston members.

Each piston member includes a piston face and a first edge. The pistons are disposed between the upper wall and the lower wall whereby the first edge of one piston member is slidably engaged with the face of an adjacent piston member.

Each of the piston members is pivotable relative to the other so that at all times, whether the chamber defined by the piston faces and the inner side of the upper wall and the inner side of the top wall is in its maximally expanded state or in its maximally contracted state, each face coacts with an edge of the adjacent piston whereby the edge is slidably engageable along the piston face.

The pistons pivot back and forth upon their respective single pivot points, producing the expansion and contraction of the compression chamber necessary for making power. This power is carried away by a connecting rod which interconnects the piston member and a crank shaft. Each piston member drives a separate crank shaft, the crank shaft being interconnected with the single piston member by means of the connecting rod.

Where four piston members are included in the energy transfer unit, the compression chamber defined by the inner surfaces of the top and bottom wall and the faces of the piston members defines a cube. The cube is consequently expanding or contracting relative to the current position of the components of the engine.

The faces of the piston members may be planar or may be hemispherical, depending on output requirements.

The energy transfer unit of the present invention may be employed as an internal combustion engine, and when this is the case, the engine may be of a two- or four-stroke design. The energy transfer unit may also be employed as a vacuum pump or a compressor. In any event, the construction and design of the engine would be directed at such specific application.

The great advantage of the present invention is that while the pistons move toward the bottom of the stroke (the pressure inside the compression chamber dropping correspondingly), more piston surface is exposed. This allows the lowering of compression chamber pressure thereby having an increased effect on the pistons, in marked contrast to the pistons of the conventional engine. Normally, conventional piston working surface is constant, so that the system power output is directly related to the compression chamber pressure.

By increasing the working surface of the piston during the course of the power stroke (moving from top to bottom dead center), additional power output, from the same compression chamber pressure, is available for use according to the present invention.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENT OF THE PRESENT INVENTION

Figure 1:
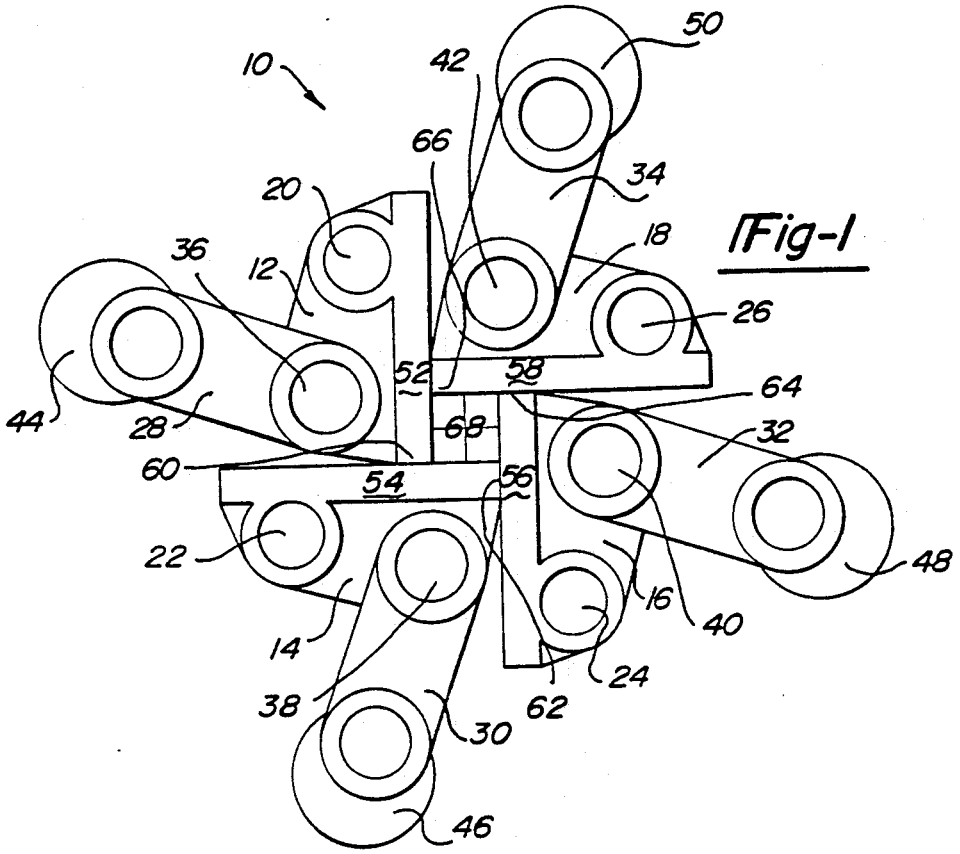
FIG. 1 is a top plan view of the piston members of the present invention and their associated connecting rods and crank shafts illustrating the piston members at their maximum compression.

The drawing discloses the preferred embodiment of the present invention. While the configuration according to the illustrated embodiment is preferred, it is envisioned that alternate configurations of the present invention may be adopted without deviating from the invention as portrayed. The preferred embodiment is discussed hereafter.

Referring to FIG. 1, a top plan view of the working elements of the present invention are illustrated, generally being indicated as 10. As illustrated in FIG. 1, four piston members, 12, 14, 16, 18, are illustrated, although as must be understood three piston members may be workable or, alternatively, more than four piston members may be workable.

Each piston member 12, 14, 16, 18 includes a fixed pivot 20, 22, 24, 26 respectively. The fixed pivots 20, 22, 24, 26 interconnect the piston members 12, 14, 16, 18 with the upper wall (not shown) and the lower wall (not shown). The upper and lower walls are in a fixed parallel relation to one another.

Each piston member 12, 14, 16, 18 includes and has attached thereto a connecting rod 28, 30, 32, 34 respectively. The connecting rods 28, 30, 32, 34 are pivotably interconnected with the piston members 12, 14, 16, 18 at interconnecting pivots 36, 38, 40, 42.

Each connecting rod 28, 30, 32, 34 is pivotably attached to a crank shaft 44, 46, 48, 50 respectively. Of course, modifications of the method of interconnecting each piston member 12, 14, 16, 18 may be modified from the assembly as illustrated herein.

Each piston member 12, 14, 16, 18 includes a piston face 52, 54, 56, 58 respectively. Terminating each face 52, 54, 56, 58 at one end is a first edge 60, 62, 64, 66 respectively.

As illustrated, the first edge 60 of the first of piston member 12 slidingly engages the face 54 of the piston member 14. The first edge 62 of the piston member 14 slidably engages the face 56 of piston member 16. The first edge 64 of the piston member 16 slidably engages the face 58 of the piston member 18. The first edge 66 of the piston member 18 slidably engages the face 52 of the piston member 12.

By this construction, each of the respective faces 52, 54, 56, 58 of the pistons 12, 14, 16, 18 are in constant contact with the adjacent piston face. Accordingly, between the piston faces 52, 54, 56, 58 and the upper wall (not shown) and the lower wall (not shown), there is defined a compression chamber 68. The compression chamber 68 is alternatingly expanding or contracting, this state being dependent upon a present stroke of the engine.

Figure 2:
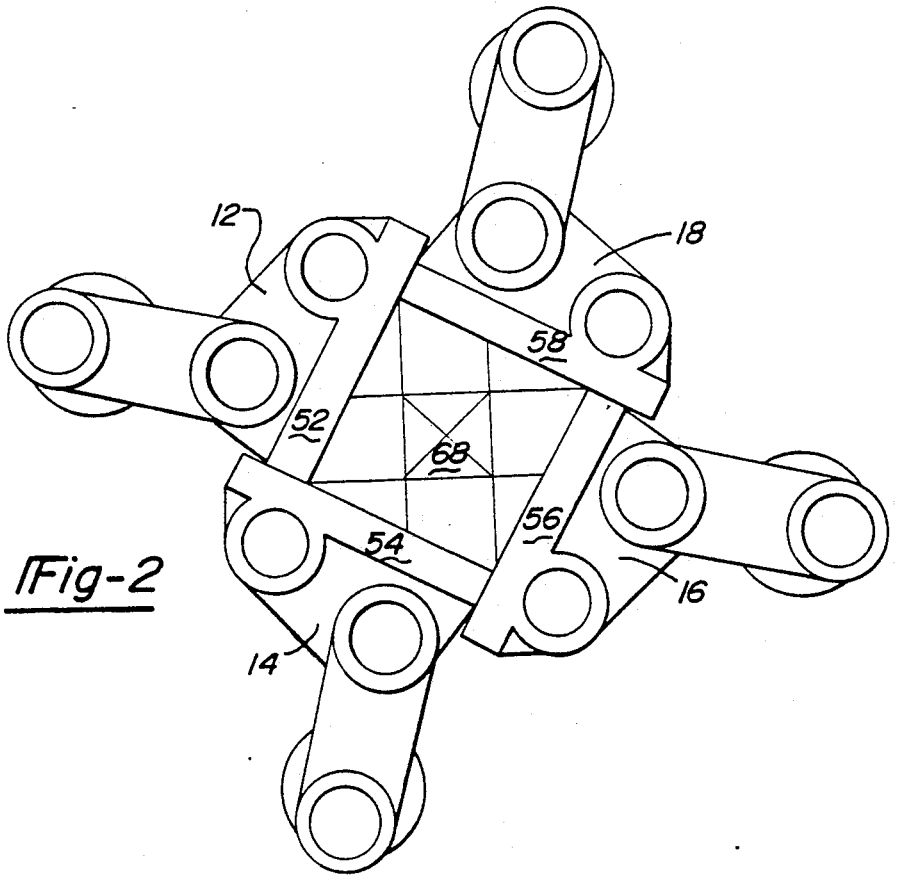
FIG. 2 is the same view of FIG. 1, excepting that the piston members are now at their maximally expanded state at bottom dead center.

With respect to FIG. 2, the compression chamber 68 is expanded cuboidally relative to the compression chamber 68 illustrated in FIG. 1. As can be readily seen in FIG. 2, the faces 52, 54, 56, 58 of the piston members 12, 14, 16, 18, respectively are still in right angle contact with each other, thereby fully securing compression within the chamber 68. Also as illustrated, the crank shafts 44, 46, 48, 50 show their positions at bottom dead center. FIG. 2 represents the compression chamber 68 at its maximally expanded point.

Figure 3:
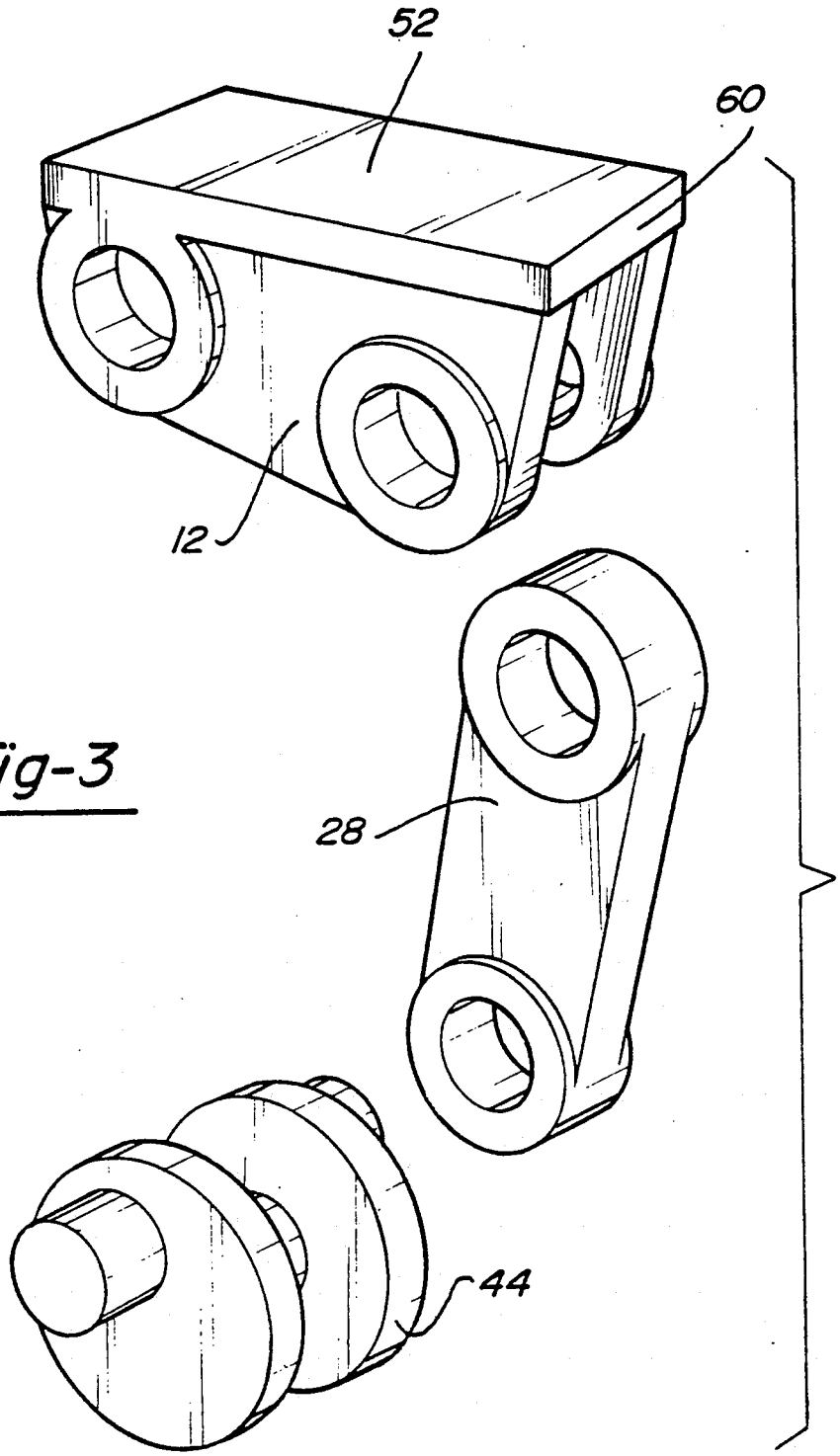
FIG. 3 is a perspective view of a single piston member assembly illustrating a connecting arm and an associated crankshaft.

With reference now to FIG. 3, an exploded perspective view of the elements of a single piston member and its associated crank shaft and interconnecting connecting rod is illustrated. As shown here, the piston member 12 is situated above the connecting rod 28 which itself is above the crank shaft 44. As illustrated, the face 52 of the piston member 12 is planar, although a hemispherical shape may be preferred. If the hemispherical shape (not shown) is preferred, the face 52 would have an axially elongated and centrally positioned elevation and the edge 60 would have defined therein a groove for accomodating the adjacent piston face. Again, however, the connecting elements, to draw power from the piston member 12 to a crank shaft, may be modified from the elements as shown to best achieve the maximum performance from the energy transfer unit.

Having described my invention, however, many modifications thereto will become apparent to those skilled in the art to which it pertains without deviation from the spirit of the invention as defined by the scope of the appended claims.

I claim:

1. An energy transfer unit comprising:

a transfer unit housing having a top inner wall and a bottom inner wall, said walls being in a parallel and fixed relationship to one another; and at least three movable piston members, each of said piston members having a piston face and at least one edge;

said faces of said piston members being pivotably situated between said walls;

said faces coacting with each other by said edge of one piston contacting with and sliding against said face of an adjacent piston, whereby said piston faces collectively define an alternatingly expandable and contractable surface area within said compression chamber; and a number of connecting rods and crankshafts equal to the number of said piston members, one of said connecting rods interconnecting one each of said piston members and said crankshafts.

2. The energy transfer unit of claim 1 wherein said faces of said pistons are planar.

3. The energy transfer unit of claim 1 wherein said faces of said pistons are hemispherical.

4. The energy transfer unit of claim 1 wherein said at least three movable piston members number four.

5. The energy transfer unit of claim 4 wherein said faces of said adjacent pistons are perpendicularly situated with respect to each other.

6. The energy transfer unit of claim 4 wherein said surface area defines an alternatingly expandable and contractable cuboidally-shaped area.

7. The energy transfer unit of claim 1 wherein said unit is an internal combustion engine.

8. The energy transfer unit of claim 7 wherein said engine is a two-stroke engine.

9. The energy transfer unit of claim 7 wherein said engine is a four-stroke engine.

10. The energy transfer unit of claim 1 wherein said unit is a vacuum pump.

11. The energy transfer unit of claim 1 wherein said unit is a compressor.

12. The energy transfer unit of claim 1 wherein each of said piston members includes a fixed pivot for movably mounting between said top inner wall and said bottom inner wall; and each of said faces defines a parallelogram.

13. The energy transfer unit of claim 1 wherein said piston members number three and said surface area defines an alternatingly expandable and contractable triangularly-shaped area when viewed in cross section.

* * * * *